US007294363B2

(12) United States Patent
Grove, III et al.

(10) Patent No.: US 7,294,363 B2
(45) **Date of Patent: *Nov. 13, 2007**

(54) METHODS OF FORMING DECORATIVE VEILS

(75) Inventors: Dale A. Grove, III, Arnhem (NL); Freek Schreuder, Arnhem (NL); Paul Geel, VK Doorwerth (NL); David R. Hartman, Granville, OH (US)

(73) Assignee: Owens Corning Intellectual Capital, LLC DE (US)

( * ) Notice: Subject to any disclaimer, the term of this patent is extended or adjusted under 35 U.S.C. 154(b) by 201 days.

This patent is subject to a terminal disclaimer.

(21) Appl. No.: 10/325,040

(22) Filed: Dec. 19, 2002

(65) Prior Publication Data

US 2004/0121075 A1 Jun. 24, 2004

(51) Int. Cl.
*B05D 1/36* (2006.01)
*E04B 1/00* (2006.01)

(52) U.S. Cl. ..... 427/407.1; 427/299

(58) Field of Classification Search ..... 427/180, 427/202, 203, 289, 293, 299, 407.1, 407.3, 427/355, 359; 52/144, 145
See application file for complete search history.

(56) References Cited

U.S. PATENT DOCUMENTS

| | | | | | |
|---|---|---|---|---|---|
| 3,196,030 | A | * | 7/1965 | Petry | 427/264 |
| 3,224,894 | A | * | 12/1965 | Palmer | 427/264 |
| 3,310,422 | A | * | 3/1967 | Petry | 428/215 |
| 3,836,417 | A | | 9/1974 | Yaeger | |
| 3,908,059 | A | | 9/1975 | Prince | |
| 4,008,351 | A | * | 2/1977 | Inoue et al. | 428/411.1 |
| 4,126,727 | A | | 11/1978 | Kaminski | |
| 4,245,689 | A | | 1/1981 | Grard et al. | |
| 4,247,338 | A | * | 1/1981 | Ziobrowski | 106/419 |
| 4,258,098 | A | * | 3/1981 | Bondoc et al. | 162/156 |
| 4,278,483 | A | | 7/1981 | Mansolillo | |
| 4,299,874 | A | | 11/1981 | Jones et al. | |
| 4,321,087 | A | * | 3/1982 | Levine et al. | 75/356 |
| 4,407,981 | A | * | 10/1983 | Aaronson | 521/107 |
| 4,409,280 | A | | 10/1983 | Wiley et al. | |
| 4,438,166 | A | | 3/1984 | Gluck et al. | |
| 4,547,245 | A | | 10/1985 | Colyer | |
| 4,690,859 | A | | 9/1987 | Porter et al. | |
| 4,791,022 | A | | 12/1988 | Graham | |
| 4,806,571 | A | * | 2/1989 | Knobel et al. | 521/107 |
| 4,840,997 | A | * | 6/1989 | Snell et al. | 525/210 |
| 5,001,005 | A | | 3/1991 | Blanpied | |
| 5,011,690 | A | * | 4/1991 | Garvey et al. | 424/401 |
| 5,112,678 | A | | 5/1992 | Gay et al. | |
| 5,260,118 | A | | 11/1993 | Lussi et al. | |
| 5,379,806 | A | | 1/1995 | Matthews et al. | |
| 5,670,585 | A | | 9/1997 | Taylor et al. | |
| 5,684,278 | A | | 11/1997 | Yasukawa et al. | |
| 5,698,304 | A | | 12/1997 | Brandon et al. | |
| 5,753,371 | A | * | 5/1998 | Sullivan et al. | 428/406 |
| 5,820,975 | A | | 10/1998 | Oda et al. | |
| 5,869,166 | A | * | 2/1999 | Caldwell | 428/142 |
| 5,965,257 | A | | 10/1999 | Ahluwalia | |
| 6,267,843 | B1 | | 7/2001 | Helwig et al. | |
| 6,495,206 | B1 | * | 12/2002 | Desai | 427/243 |
| 2001/0056133 | A1 | | 12/2001 | Montgomery et al. | |

FOREIGN PATENT DOCUMENTS

| | | |
|---|---|---|
| EP | 0 166 153 | 6/1990 |
| EP | 0839856 | 5/1998 |
| EP | 0845346 | 6/1998 |
| EP | 1 038665 | 9/2000 |
| EP | 1251215 | 10/2002 |
| WO | WO 01/47680 | 7/2001 |
| WO | WO 02/060702 | 8/2002 |
| WO | WO 03/031135 | 4/2003 |

* cited by examiner

*Primary Examiner*—William Phillip Fletcher, III
(74) *Attorney, Agent, or Firm*—Inger H. Eckert; Margaret S. Millikin

(57) ABSTRACT

Methods that apply decorative particles in-line in the manufacturing process to form a decorative structured mat or veil that is ready for direct commercial application. The decorative particles or decorative paint patterns should be of a size and/or color to be visible at a distance of five meters from the decorative mat or veil. In preferred embodiments, the particle size ranges from about 100 to about 500 microns in size. A formulation for coating a glass fiber mat with decorative particles is also provided.

36 Claims, No Drawings

METHODS OF FORMING DECORATIVE VEILS

TECHNICAL FIELD AND INDUSTRIAL APPLICABILITY OF THE INVENTION

The present invention relates generally to methods for forming decorative wall or acoustic veils, and more particularly, to methods that apply decorative particles, paint, or microencapsulated blowing agent in-line in the manufacturing process and off-line to form a decorative structured face or veil that is ready for direct commercial application. Formulations for coating glass fiber veils with decorative particles are also provided.

BACKGROUND OF THE INVENTION

Decorative sheet materials are well known in the art and are widely used as surface coverings such as for walls, countertops, ceilings, and floors. In fact, the decoration of these surface coverings is of great importance in increasing the product's marketability and consumer desirability. As an example, in ceiling acoustics, post manufacturers secondarily treat veils through processes that spray paint and particles upon the decorative surface of the veil. Acoustic board manufacturers would rather receive a pre-treated material due to both cost and performance benefits. A range of aesthetics is desired from a smooth white, textured white, smooth color, or textured color with decorative special effects.

However, decorative veils and acoustic facers formed by current methods require additional painting or post treatment, especially if decorative markings are desired. Often these post treatments compromise the acoustic performance, fire resistance, and durability. It is therefore desirable to provide a formulation and methods for forming a decorative wall or acoustic veil that overcomes the disadvantages of the prior art.

SUMMARY OF THE INVENTION

Accordingly, an important object of the present invention is to provide in-line and off-line methods of forming a decorative structured wall or acoustic veil that is ready for direct commercial application.

It is another object of the present invention to provide a formulation containing decorative particles that can be used in-line to form a decorative structured wall or acoustic veil.

It is also an object of the present invention to include decorative particles or decorative paint on a decorative mat or veil that are visible at a distance of 5 meters.

It is yet another object of the present invention to provide an inexpensive approach to forming a decorated finished facer that is ready for direct commercial application.

It is a further object of the present invention to provide a wall or acoustic veil that has anti-fouling properties to prevent discoloration over time.

It is yet another feature of the present invention that the decorative particles or decorative paint in the mat or veil can be formed in a pattern or can be randomly distributed.

It is an advantage of the present invention that the formulation for forming a decorative wall or acoustic veil is used in-line in the manufacturing process.

These and other objects, features, and advantages are accomplished according to the present invention by providing methods that apply paint and/or decorative particles in-line during the manufacturing process to form a decorative structured mat or veil that is ready for direct commercial application. The decorative particles or decorative paint patterns are of a size and/or color to be visible at a distance of at least 5 meters from the decorative veil and can be either randomly distributed or formed in a pattern.

The foregoing and other objects, features, and advantages of the invention will appear more fully hereinafter from a consideration of the detailed description that follows.

DETAILED DESCRIPTION AND PREFERRED EMBODIMENTS OF THE INVENTION

The present invention solves the aforementioned disadvantages and problems of the prior art by providing methods of forming a decorative mat or veil that adds decorative particles in-line during the manufacturing process. As a result, the decorative veil is ready for direct commercial application onto acoustic substrates or onto the wall. The terms mat, veil, and facer are used interchangeably herein.

The decorative particles should be of a size and/or color to be visible at a distance of five meters from the acoustic facer or veil. In general, the particles may be of any suitable size, shape, and density so long as the particles adhere and remain adhered to the glass fiber mat. In preferred embodiments, the particle size ranges from about 100 to about 500 microns in size. Particles much smaller than 100 microns only serve to color the veil and will not give the veil the desired distinctive paint, particulate markings, or three dimensional effect. Particles in excess of 500 microns are subject to settling effects, which may result in extreme application problems due to the inability of the particles to stay in suspension. Large particles will also create problems in the winding process since they will protrude through one mat layer to the next.

Suitable examples of decorative particles for use in the present invention include, but are not limited to, mica, thermoplastic polyester glitter, thermosetting polyester glitter, expandable graphite, polyvinylchloride glitter, alumina, aluminum flake, glass beads, calcium carbonate, clay, ATH, kaolin, silicon dioxide, wollastonite, sand, magnesium hydroxide, aluminum oxide, wood fiber, jute fibers, nutshells, rice hulls, other natural fillers, paper, plastic beads, and talc. Hard particles, such as alumina, aluminum flake and glass beads should only be employed if the secondary processing equipment avoids nip points, such as in a flood and extract, kiss coating, secondary former, and dry application methods. If nips are present in the secondary processing, softer particles should be employed. Preferably, the particles are added to the mat in an amount of from about 0.5% to 10%, and preferably in an amount of from 0.5% to 5%.

Any glass fiber mat is suitable for use with the above-described formulation. However, the mat is preferably a closed mat having glass filaments in the range of 6-13 micron/3-9 mm fibers in length or combinations thereof.

In one embodiment, the decorative particles are added to a formulation that includes a high loading of flame retardant fillers, e.g., calcium carbonate, as well as, aluminum trihydrate (ATH), magnesium hydroxide, nitrogen-phosphorous based flame retardants, such as intumescent nitrogen-phosphorous compounds, organic nitrogen-phosphorous compounds, inorganic nitrogen-phosphorous compounds, melamine based products such as melamine-formaldehyde, melamine-polyphosphate, melamine cyanurate, melamine-phosphate, melamine-phenol-formaldehyde copolymers, acrylic copolymers, and bromine and chlorine halogenated fillers and/or resins optionally combined with antimony trioxide or antimony pentoxide synergists. Optionally, the flame retardant fillers can contain a micro-encapsulated blowing agent. The amount of added micro-encapsulated blowing agent increases with the desired surface texture. Depending upon the selected flame retardant system, the flame retardant fillers may be present in an amount of at least 10% by weight.

The presence of thickeners and whiteners in the formulation can provide added desirable attributes. For example, the thickener prevents particle settling and provides resistance to shear or elongation rate striation markings that may arise under processing conditions. Typical thickeners, which may be present at levels ranging from 0.1-5% by weight of the solid binder content, include polyurethane copolymers, hydroxy-ethyl cellulose, and polyacrylamides. It was determined that pH dependent thickeners, such as polyacrylates, were not preferred and that thickeners displaying pseudoplastic behavior were less preferred. Preferred thickeners include Rohm and Haas's Acrysol RM-8W and Acrysol RM-2020, which are both polyurethane based, and Hercule's Natrosol, a hydroxy-ethyl cellulose thickener. Polyacrylamides, like Nalco 7768, were even less preferred due to pseudoplastic rheological behavior.

Optionally, the formulation may include anti-static agents, antimicrobial agents, and/or fungicides. Fouling of acoustic facers and veils primarily occurs through accumulated charged particles, biological growth, and fungal growth. Biological or fungal attacks are more typically a problem in pools, showers, and other hot, humid environments, but can occur in any acoustic facings or wall veils. To prevent discoloration or unwanted microbiological or fungal attack, anti-static agents in an amount of 0.5 to 3% by weight and antimicrobial or antifungal agents in an amount of 0.1 to 2% by weight can be added to the formulation. Suitable examples of anti-static agents include Ciba's Zerostat FC (alkali metal phosphates), Ciba's Zerostat AT (modified organic phosphorous), Ciba's Zerostat NNP (ethyoxylated alcohol), and Clariant's Elfugin (phosphate ester). Suitable examples of antimicrobial agents include Clariant's JMAC product (silver chloride in $TiO_2$), Rohm & Haas's Kathon LXE (5-chloro-2-methyl-4-isothiazoline-3-on), Rohm & Haas's Kathon 893 (2-N-octyl-4-isothiazolin-3-on), Ciba's Tinosan AM110, zinc oxide, and Busan 11-M2 ($BaB_2O_4.H_2O$). By adding these anti-static and antimicrobial agents, the color of the aesthetic veil can be preserved.

In addition, the formulation may optionally include optical whiteners, pigments, and/or pH adjusters. Optical whiteners, such as Leucophor based products, can be added at between 0.1-0.3% to increase the reflectivity of white surfaces to a desired L* value. Pigments, especially $TiO_2$, ATH, zinc oxide, and carbon black, can be used at levels of 0.5-5% to provide desired color aesthetic value. Lastly, pH adjustment may be necessary in cases where alkaline additives, like ATH and $M_g(OH)_2$ are employed.

Decorative particles are applied to a glass fiber mat that has first been initially formed and treated with a pre-binder. Polyvinyl alcohol is a preferred pre-binder due to its affinity to water, superior formnation, and low toxicology. Other possible pre-binder resins could include starch, cellulosic resins, polyacrylamides, water soluble vegetable gums, urea-formaldehyde, melamine-formaldehyde, melamine-phenol-formaldehyde copolymers, acrylic copolymers, and polyamide resins. Typical initial polyvinyl alcohol levels range from 8-20 wt % in the impregnated mat. To form the polyvinyl alcohol impregnated mat, polyvinyl alcohol powder is initially pretreated with hot water, dissolved, cooled, and then added to the whitewater system along with 3-9 mm long, 6-13 micron diameter, 9501 or 9503 sized glass fibers, and various other whitewater ingredients including an anionic polyacrylamide, dispersant, defoamer, and biocide that is used in the whitewater. If more closed veils are desired, mixtures of 6 micron and other micronage glass fibers can be employed in the pre-impregnated mat. The mat is then formed in a manner to provide a nearly 1/1 (MD/CD) tensile ratio by matching the wire speed with the slurry speed and through judicious wall settings, drop leg flow rates, and other means known to those skilled in the art. Uniform randomly dispersed fiber orientation is preferred since the resulting ceiling panel, which employs the mat facer, should be capable of installation in any direction without showing preferential markings.

The preliminary formed mat is subsequently dried to form a base veil. This base veil is then subsequently treated with subsequent binder impregnation steps, painting steps, and/or additional particle application steps, dried, and wound. The formed mat has excellent particle dispersion.

In one preferred embodiment of this invention a textured surface is achieved through the incorporation of blowing agents into micro-encapsulated acrylic resin particles, such as Expancel 054, or micro-encapsulated PVDC/acrylic resin particles, like Expancel 461, in the binder system to achieve a fine grain, foamy structure that is aesthetically appeasing. This material, when combined with a nitrogen-phosphorous flame retardant system and a PVC copolymeric resin, can achieve flame retardant properties which are required for building facers. It should be noted, however, that such micro-encapsulated acrylic resins can be employed in the absence of a flame retardant binder. Such a textured veil can be produced in-line, such as for large volume applications, or off-line at flooded-nip coaters for smaller volume applications.

Texture surfaces may be further incorporated by subjecting the formed mat through embossing rolls. Holes, slices, and other patterns can be readily sliced into the mat. Embossing techniques may further be used to create three dimensional images by lightly embossing the foamy mat described in the previous paragraph.

In a further embodiment, paint may be added through an off-line roto-screen or roto-gravure technique. Roto-screens are capable of producing either uniform patterns or random patterns based on the size and design pattern on the roller applicator. Randomness of the paint placement can be achieved by sizing two screens at non-integral diameter ratios. Patterns on the mat are achieved by using either one screen or by using proportional diameter ratios of multiple screens, depending upon the nature of the desired pattern. In the roto-screen technique, paint or binder, which may optionally contain small decorative particles, are located internally in a round drum. As the mat passes around the drum, the paint or binder containing the decorative particles is pressed to the outside and onto the mat. Roto-gravures offer the possibility of providing grain patterns or other unique designs on the mat. Patterns or randomness is achieved through whatever design is present on the screens/rollers which contact the web. In this case the gravure roll is fed through a metering roll which may be fed from other rollers to achieve a uniform resin delivery rate. The pattern on this roll is then transferred on to the moving veil.

The two step operation of forming the mat followed by the subsequent coating of paint and/or particles through roto-screen or roto-gravure technologies offers significant efficiency improvements over conventional methods of forming decorative mats since this direct, on-line method avoids multiple serial production runs.

In another embodiment, the decorative particles are applied to the mat through a multi-layered headbox. In general, multiple headboxes refers to the process whereby particles/fiber/particulates are removed from a slurry solution and are deposited on the materials located on a moving forming wire above a preliminary mat layer. In this process, a first layer is deposited on the mat in a first formation stage and a secondary formed layer is deposited above the first layer. The first layer provides a foundation for smaller particles to be captured in a secondary coating. Normally, this first layer is a pre-impregnated polyvinyl alcohol mat. Decorative particles, such as alumina-oxide, mica, talc, glitter, other fibers, etc., can be captured and applied to the preformed mat as opposed to passing the mat through the forming layers and the forming wire. This creates a higher first pass efficiency leading to lower concentrations of particles in the slurry and more uniform dispersion. A secondary binder can then be then added through a standard flood and extract or through kiss type coating from the back of the veil. Since the secondary binder step normally applies a white binder and the majority of decorative veils for use in structured acoustic facers or for use in wall or ceiling coverings are white, it is easy to cover the added particles and still retain the three dimensional formation of the veil or acoustic facer. However, in situations where color or glitter is desired, it is necessary to use a secondary binder that is translucent in order to visibly project the particles through the binder coating.

In a preferred embodiment, decorative particles are added in a dry powder form through the use of bristle rollers such as supplied by JWS and Terronics. In this embodiment, dry particles are added to the pre-impregnated polyvinyl alcohol mat after it has passed through at least one secondary binder application, i.e., it is important for the mat to be wet and sticky to fix the dry particles. The secondary binder treatment could include application methods such as flooded nip, reverse roll coating, kiss coating, and flood and extract methods. Dry particles are pneumatically conveyed to a feeding hopper that is located above a series of brushy rollers. The first brushy rollers evenly partitions the particles in the cross direction, whereas subsequent brushes provide additional partitioning and create random placement of the decorative particles to the binder laden fiberglass mat located below and moving past the brushy rollers/powders. A top coat is then applied through either mayer-rod, kiss coating, or spray coating to hold the particles in place. It is important that the top coat contain a clear binder, such as melamine, if color aesthetics are desired. In particular, if an opaque binder is used as the top coat, the colored particles will be immersed in the natural color of the opaque binder.

The brushy roller technique has many advantages, including the avoidance of intersection lines that occur whenever a series of particulate sprayers is involved. Furthermore, it is impossible to obtain uniform coverage with a spray technique over a wide width. In addition, this technique is preferred due to the ease of switching particles, lack of particle settling issues, and the ease of achieving randomness over wide widths.

To prevent wear issues from handling the decorative veil, rollers that contact the rough side of the veil should be either hardened through specialized treatments or replaced with air bars. A protective paper layer can be added between mat layers to prevent the winding tensions and movements from scraping the particles from the surface of the veil and protect layers during the winding step.

As one example of the application of this invention, a pretreated flame retardant veil consisting of a 70 gram veil formed of 6 mm long, 11 micron fiber diameters with a 15% polyvinyl alcohol pre-binder level and a flame retardant phosphorous/styrene-acrylate based binder was treated through a reverse roll coating technique with an off-line secondary coater operation which employed a binder consisting of mixture of 53% Martifin OL-005, 10.6% Magnifin H5, 10.6% Durcal 5, 7.1% styrene/acrylate Acronal LR8988, 5% of Acrysol RM-8W, 4% decorative particles, 9% water, 0.3% Melamine Formaldehyde, 0.2% Leucophor UO (optical brightener), and 0.2% citric acid for pH balance.

A second example of this invention was the treatment of a pretreated flame retardant veil consisting of a 70 gram veil composed of 6 mm length/11 micron fiber diameter with a 15% polyvinyl-alcohol pre-binder level and a flame retardant phosphorous styrene-acrylate based binder to an off-line roto-screen operation which employed a flame retardant paint formulation. A speckled/spotted mat was created through the judicious placement of paint spots.

As a third example of this invention, the same pre-treated mat as above was sprayed with a melamine resin, passed under dry particles which were deposited from a brushy roller assembly, and then post treated with a secondary melamine resin to hold the particles firmly in place. The result was randomly placed particles.

As a fourth and preferred application of this invention, a secondary binder mixture of Expancel 461, an acrylic/PVDC copolymer containing a micro-encapsulated blowing agent, Bemiflame GF, a phosphorous-nitrogen flame retardant, combined with a copolymeric resin of polyvinylchloride and polyethylene, Airflex CE35, and an optical brightener, such as Leucophour UO, were added as a direct secondary binder to the mat. When dried under a profile to quickly remove the water followed by a decreasing temperature profile, it was possible to obtain a white veil with texture directly on-line.

The invention of this application has been described above both generically and with regard to specific embodiments. Although the invention has been set forth in what is believed to be the preferred embodiments, a wide variety of alternatives known to those of skill in the art can be selected within the generic disclosure. The invention is not otherwise limited, except for the recitation of the claims set forth below.

Having thus described the invention, what is claimed is:

1. A method of forming a decorative structured veil comprising:

adding a formulation including decorative particles having a particle size from about 100 to about 500 microns, a resin, a thickener, and a binder to a mat impregnated with a pre-binder to form a decorated mat, said decorative particles being distributed on said mat to provide a particle-decorated surface, said decorative particles giving said surface a three dimensional effect;

drying said particle-decorated mat; and forming said particle-decorated mat into a decorative structured veil.

2. The method of claim 1, further comprising the step of adding a secondary flame retardant binder in an amount of at least 10% by weight prior to said adding step.

3. The method of claim 2, wherein said secondary flame retardant binder is at least one member selected from aluminum hydroxide, magnesium hydroxide, calcium carbonate, intumescent nitrogen-phosphorous compounds, organic nitrogen-phosphorous compounds, inorganic nitrogen-phosphorous compounds, melamine-formaldehyde, melamine-polyphosphate, melamine cyanurate, melamine-phosphate, melamine-phenol-formaldehyde copolymers, acrylic copolymers, brominated compounds, chlorinated compounds, resins combined with antimony trioxide and resins combined with antimony pentoxide.

4. The method of claim 2, wherein said secondary flame retardant binder includes a micro-encapsulated blowing agent.

5. The method of claim 1, wherein said pre-binder is at least one member selected from polyvinyl alcohol, starch, cellulosic resins, polyacrylamides, water soluble vegetable gums, urea-formaldehyde, melamine-formaldehyde, melamine-phenol-formaldehyde copolymers, acrylic copolymers and polyamide resins.

6. The method of claim 5, wherein said pre-binder is polyvinyl alcohol.

7. The method of claim 6, wherein said polyvinyl alcohol is present in said impregnated mat in an amount of from 8-20%.

8. The method of claim 6, further comprising the step of treating a fiberglass mat with polyvinyl alcohol to form said impregnated mat prior to said adding step.

9. The method of claim 8, further comprising the step of drying said impregnated mat subsequent to said treating step.

10. The method of claim 1, further comprising the step of adding a post binder to hold said decorative particles to said mat during subsequent handling prior to said forming step.

11. The method of claim 10, further comprising the step of drying said decorated mat after adding said post binder.

12. The method of claim 1, wherein said thickener is present in an amount of from 0.1-5% and is at least one member selected from polyurethane, hydroxy-ethyl cellulose, polyacrylamides and combinations thereof.

13. The method of claim 1, wherein said particles are at least one member selected from mica, thermoplastic polyester glitter, thermosetting polyester glitter, expandable graphite, polyvinylchloride glitter, alumina, aluminum flake, glass beads, calcium carbonate, clay, ATH, kaolin, silicon dioxide, wollastonite, sand, magnesium hydroxide, aluminum oxide, wood fiber, jute fibers, nutshells, rice hulls, other natural fillers, paper, plastic beads and talc.

14. The method of claim 13, wherein said particles are present in said formulation in an amount of from 0.5-10%.

15. The method of claim 1, wherein said resin includes a micro-encapsulated blowing agent in an amount of 5-50% to create a foamy veil.

16. The method of claim 15, further comprising the step of treating said decorative mat with a flame retardant binder.

17. The method of claim 16, further comprising the step of passing said decorated mat over embossing rolls to create three dimensional images on said foamy veil.

18. The method of claim 1, wherein said formulation further includes at least one member selected from anti-static agents, antimicrobial agents, fungicides, optical whiteners, pigments and pH adjusters.

19. The method of claim 18, wherein said antimicrobial and said antifungal agents are present in an amount of from 0.1-2% by weight and said anti-static agents are present in an amount of from 0.5-3%.

20. A method of forming a decorative structured veil-comprising:

adding a formulation including decorative particles, a resin, a thickener, and a binder to a mat impregnated with a pre-binder to form a decorated mat, said decorative particles being distributed on said mat to provide a particle-decorated surface;

drying said particle-decorated mat; and forming said particle-decorated mat into a decorative structured veil;

wherein said decorative particles impart a three dimensional effect to said decorative structured veil.

21. The method of claim 20, further comprising the step of adding a secondary flame retardant binder in an amount of at least 10% by weight prior to said adding step.

22. The method of claim 21, wherein said secondary flame retardant binder is at least one member selected from aluminum hydroxide, magnesium hydroxide, calcium carbonate, intumescent nitrogen-phosphorous compounds, organic nitrogen-phosphorous compounds, inorganic nitrogen-phosphorous compounds, melamine-formaldehyde, melamine-polyphosphate, melamine cyanurate, melamine-phosphate, melamine-phenol-formaldehyde copolymers, acrylic copolymers, brominated compounds, chlorinated compounds, resins combined with antimony trioxide and resins combined with antimony pentoxide.

23. The method of claim 21, wherein said secondary flame retardant binder includes a micro-encapsulated blowing agent.

24. The method of claim 20, wherein said pro-binder is at least one member selected from polyvinyl alcohol, starch, cellulosic resins, polyacrylamides, water soluble vegetable gums, urea-formaldehyde, melamine-formaldehyde, melamine-phenol-formaldehyde copolymers, acrylic copolymers and polyamide resins.

25. The method of claim 24, wherein said pre-binder is polyvinyl alcohol.

26. The method of claim 25, wherein said polyvinyl alcohol is present in said impregnated mat in an amount of from 8-20%.

27. The method of claim 20, further comprising the step of treating a fiberglass mat with polyvinyl alcohol to form said impregnated mat prior to said adding step.

28. The method of claim 20, further comprising the step of drying said impregnated mat subsequent to said treating step.

29. The method of claim 20, wherein said thickener is present in an amount of from 0.1-5% and is at least one member selected from polyurethane, hydroxy-ethyl cellulose, polyacrylamides and combinations thereof.

30. The method of claim 20, wherein said particles are at least one member selected from mica, thermoplastic polyester glitter, thermosetting polyester glitter, expandable graphite, polyvinylchloride glitter, alumina, aluminum flake, glass beads, calcium carbonate, clay, ATH, kaolin, silicon dioxide, wollastonite, sand, magnesium hydroxide, aluminum oxide, wood fiber, jute fibers, nutshells, rice hulls, other natural fillers, paper, plastic beads and talc.

31. The method of claim 30, wherein said particles are present in said formulation in an amount of from 0.5-10%.

32. The method of claim 20, wherein said resin includes a micro-encapsulated blowing agent in an amount of 5-50% to create a foamy veil.

33. The method of claim 20, further comprising the step of treating said decorative mat with a flame retardant binder.

34. The method of claim 20, further comprising the step of passing said decorated mat over embossing rolls to create three dimensional images on said foamy veil.

35. The method of claim 20, wherein said formulation further includes at least one member selected from anti-static agents, antimicrobial agents, fungicides, optical whiteners, pigments and pH adjusters.

36. The method of claim 35, wherein said antimicrobial and said antifungal agents are present in an amount of from 0.1-2% by weight and said anti-static agents are present in an amount of from 0.5-3%.

* * * * *